US007237478B1

(12) United States Patent
Gosis et al.

(10) Patent No.: US 7,237,478 B1
(45) Date of Patent: Jul. 3, 2007

(54) ASYMMETRICAL STRAP CHUTE AND RELEASE SYSTEM

(75) Inventors: Anatoly Gosis, Palatine, IL (US); Thomas A. Powers, Arlington Heights, IL (US); Frank Otte, Mount Prospect, IL (US); Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/461,789

(22) Filed: Aug. 2, 2006

(51) Int. Cl.
*B65B 13/04* (2006.01)

(52) U.S. Cl. ..... 100/26; 100/29; 53/589

(58) Field of Classification Search ..... 100/8, 100/14, 25, 26, 29, 33 PB; 53/589; 226/118.2; 198/860.3; 254/403
See application file for complete search history.

(56) References Cited

U.S. PATENT DOCUMENTS 3,179,037 A * 4/1965 Cranston, Jr. et al. ..... 100/4
3,613,557 A * 10/1971 Coleman ..... 100/26
4,697,510 A * 10/1987 Cranston et al. ..... 100/14
5,251,544 A * 10/1993 Abrams ..... 100/26
6,990,895 B2 1/2006 Powers et al.

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

An asymmetrical chute system is for use in a strapping machine of the type for feeding a strapping material around a load, positioning, tensioning and sealing the strapping material around the load. The strapping machine has a feed head, a strap chute defining a strap path through which the strapping material is passed and a sealing head. The chute system includes a base, a stationary guard having an inclined wall extending, at least in part, over the strap path and a movable guard. The movable guard is movable relative to the base and the stationary guard into and out of engagement with the stationary guard inclined wall to open and close the strap path. When the movable guard is open, the inclined wall extends over the strap path so as to form a blind portion intersecting a line normal to the strap path.

14 Claims, 2 Drawing Sheets

ASYMMETRICAL STRAP CHUTE AND RELEASE SYSTEM

BACKGROUND OF THE INVENTION

The present invention is directed to a strapping machine having an improved strap chute and release system. More particularly, the present invention is directed to an asymmetrical strap chute and release system to prevent debris from interfering with or damaging the strap chute and release system.

Strapping machines are in widespread use for securing straps around loads. One use for strapping machines is for loads of conglomerated objects that spontaneously yield multiple and sizable fragments. For example, bricks, cement blocks and the like can fragment (resulting in both large and small fragments) during the strapping operation. The fragments have been know to interfere with the proper operation of the strapping machine by clogging the strap chute and damaging the strap as it is pulled from the chute.

In one known strapping machine, the debris problem has been resolved by including a lower strap chute that is formed with a two-piece peaked guard that resembles a gable that covers the strap chute. The gabled structure opens as the strap is pulled from the chute between the guard sections or gates. In operation, as the strap is pulled from the chute the guard opens generally symmetrically, at the top, to allow the strap to pass. The guard gates are spring mounted so that they close once the strap had exited the chute. The chute includes openings at the bottom to allow debris to fall through so as to not interfere with operation of the chute. Such a guard design is disclosed in Powers, U.S. Pat. No. 6,990,895, which patent is commonly owned with the present application and is incorporate herein by reference.

Although this design works well, it has been found that debris can enter the guard and interfere with the chute when the guard is open. That is, it has been observed that debris fall into the guard (and thus to the chute) coincidentally with the guard opening to release the strap.

Accordingly, there is a need for an improved strap chute and release system that prevents the introduction of debris into the strap chute area. More desirably, such a system can be fitted onto existing strapping machines without excessive changes.

BRIEF SUMMARY OF THE INVENTION

An asymmetrical chute system is for use in a strapping machine of the type for feeding a strapping material around a load, positioning, tensioning and sealing the strapping material around the load. The strapping machine has a feed head for feeding the strapping material into strapping machine, a strap chute defining a strap path through which the strapping material is passed and a sealing head to seal overlapping courses of the strapping material onto itself. The system prevents the introduction of debris into the strap chute area. Advantageously, the chute system can be fitted onto existing strapping machines without excessive changes.

The asymmetrical chute system includes a base, a stationary guard and a movable guard. The stationary guard has an inclined wall extending, at least in part, over the strap path. The stationary guard is stationary relative to the base and the movable guard. The movable guard is movable relative to the base and the stationary guard. The movable guard is movable into engagement with the stationary guard inclined wall to open and close the strap path. When the movable guard is open, the inclined wall extends over the strap path so as to form a blind portion intersecting a line normal to the strap path.

The stationary guard includes a reverse bend back over the line normal to the strap path. Preferably, the stationary guard includes a portion extending from the reverse bend that defines a stationary guard exit wall substantially parallel to the line normal to the strap path.

In a present system, a guide is mounted at about the base, spaced from the stationary guard and the movable guard is disposed between the stationary guard and the guide. The guide is fixedly mounted relative to the stationary guard and the base.

The guide includes at least one bend to define a guide exit wall substantially parallel to and spaced from the stationary guard exit wall. The guide exit wall and stationary guard exit wall define a strap exit parallel to and aligned with the strap path. To prevent the accumulation of debris, the guide is mounted at about the base, and is spaced from the base.

In a present system the movable guard is mounted to the base by a biasing element and is biased into engagement with the stationary wall. A preferred biasing element is a flat spring.

The movable guard can be configured with a path forming leg that, in conjunction with the base, defines a path for the strap through the strap chute. A strapping machine having an asymmetrical strap chute and release system is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 1:
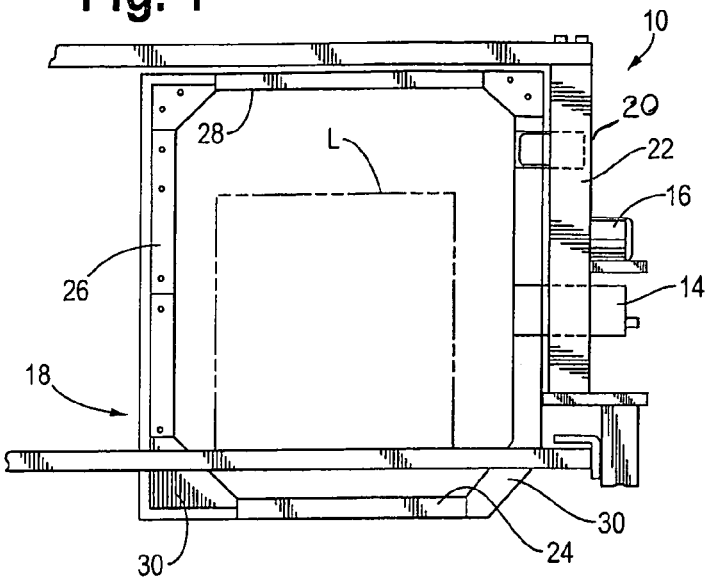
FIG. 1 is a side view of an exemplary strapping machine having an asymmetrical chute and release system embodying the principles of the present invention.

Referring to the figures and in particular to FIG. 1 there is shown a strapping machine 10 having an asymmetrical strap chute and release system 12 embodying the principles of the present invention. The illustrated machine 10 is a side-seal strapper, meaning that the strapping head (or sealing head 14), which forms the seal of the strap S onto itself is on the side of the load L (and thus the machine 10). The strapper 10 includes, generally, the sealing head 14, a feed head 16 and a strap chute 18. A frame 20 supports the various elements of the machine 10. A dispenser (not shown) supplies the strap material S to the strapper 10 (at the feed head 16).

In a typical configuration, the strap S is fed into the strapper 10 at the feed head 16 and is directed downwardly through the near leg 22 of the strap chute 18. The strap S then traverses along the bottom leg 24 of the chute 18, up the opposite (far) vertical leg 26, across the top leg 28 and back down the near leg 22 to the sealing head 14.

Once the strap S reenters the sealing head 14, the free end of the strap S is held or secured, the feed end is tensioned around the load L, and the overlapping strap courses are sealed to one another as the feed end is severed from the supply. The load L is then discharged from the machine 10.

In the course of a cycle of machine operation, as the strap S is tensioned around the load L, it is pulled from the strap chute 18. The entirety of the strap "loop" does not exit the chute 18 at once; rather, it is pulled in a sequential manner from the chute 18 onto the load L. As such, as one portion of the chute 18 is opened by the strap s exiting (at that portion), because the chute 18 is formed from elongated elements, the entirety, or at least a substantial section of the chute 18 is also opened even though the strap S has yet to be pulled from that particular section or has already been pulled from that section. This results in sections or areas of the chute 18 being open when strap S is not being pulled. This can open the chute 18 for debris to enter.

The present asymmetrical chute and release system 12 provides an enhanced debris deflection function to prevent the ingress of debris by creating a diverted path for the debris as it falls from the load L. The system 12 is formed as part of the bottom leg 24 of the chute 18 and as part of the transitions 30 between the bottom leg 24 and the vertical legs 22, 26 adjacent to the bottom leg 24 (the transition sections 30 are radial track sections).

Figure 2:
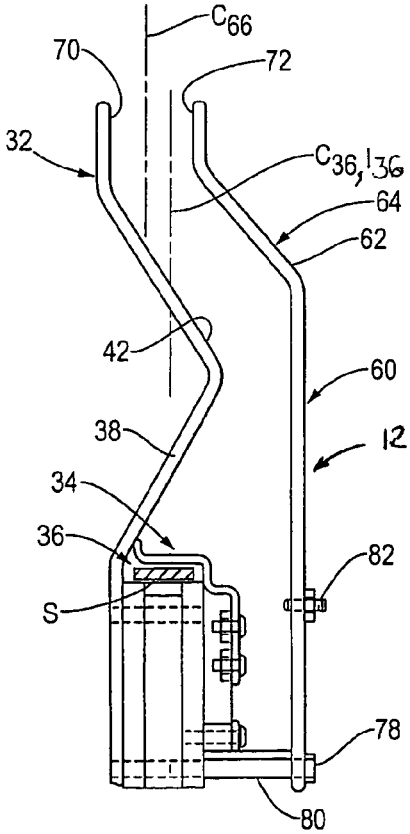
FIG. 2 is a cross-sectional view of the bottom leg of the strap chute showing the asymmetrical chute and release system with the chute in the closed state and a strap within the chute.
Figure 3:
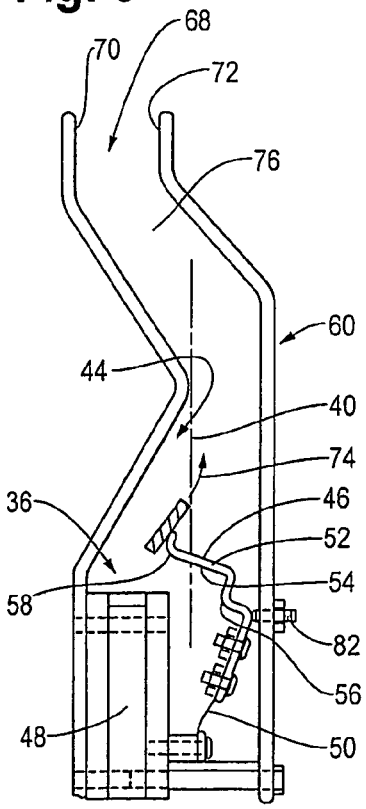
FIG. 3 is a cross-sectional view of the bottom leg of the strap chute showing the asymmetrical chute and release system with the chute in the open state and a strap exiting from the chute.

As seen in FIGS. 2 and 3, the bottom chute section 24 includes the asymmetrical chute and release system 12 which has a stationary guard portion 32 and a movable guard portion 34. The stationary guard portion 32 has an inclined or angled section 38 over the strap path 36. The guard portions 32, 34 meet along the inclined portion 38 of the stationary guard 32 to close the chute 18. In a present assembly 12, the stationary guard portion 32 extends (at the incline 38) beyond the end (as indicated at 40) of the strap path 36 and then reverses back (forming a reverse bend 42) over the center $C_{36}$ of the strap path 36. In this manner, the stationary guard 32 forms an overhang (as indicated at 44) over the movable guard 34 that, as is seen in FIG. 3, forms a vertical "blind" over the path 36 when the chute 18 is open. That is, even with the movable guard 34 urged away from the stationary guard 32 (see, FIG. 3), there is no direct vertical line of sight (e.g., along a line 136 normal to the strap path 36) into the chute 18 passed the stationary guard 32. And, with the chute 18 open (even fully open), the incline of the movable guard as indicated at 46 is such that it directs debris away from the chute 18.

In a present chute system 12, the movable guard 34 is mounted to a chute block 48 by a flat spring 50, such as a spring steel spring. Other biasing arrangements, such as coil springs or the like can also be used.

The movable guard 34 includes a path-forming leg 52 that defines the path 36 for the strap by between a wall 54 in opposing relation to the chute block 48. The movable guard 34 includes a step-like contact 56 with the chute block 48 to prevent over movement of the movable guard 34. A rounded or curved free end 58 provides a smooth surface over which the strap S traverses as it is pulled from the chute 18. The position of the movable guard 34 relative to the stationary guard 32 is such that the movable guard spring 50 is preloaded to close the chute 18.

The bottom leg 24 of the chute 18 also includes a guide 60 to re-center or re-orient the strap S as it exits the chute 18. It will be appreciated that because the chute guards 32, 34 are asymmetrical (with the stationary guard 32 extending over the center $C_{36}$ of the strap path 36), when the strap S moves beyond the stationary guard 32 it is no longer at about the center $C_{36}$ of the path 36. Accordingly, the guide 60 includes an angled leg portion 62 that redirects or reorients the exiting strap S back toward the center $C_{36}$ of the strap path 36. In addition, the stationary guard 32 includes an upper extension 64 with the reverse bend 42 that, with the guide 60, defines an exit 68 for the strap S that is about centered (see $C_{66}$) over the strap path 36. The guide angled leg portion 62 and the stationary guard upper extension 64 define a reorienting path (as indicated at 68) between them that angles back toward the strap path 36. The reorienting path 68 terminates in a pair of walls 70, 72 that are substantially parallel to the direction the strap moves (as indicated at 74) toward the load L.

It will be appreciated from a study of the figures and specifically FIGS. 2 and 3, that debris that falls into the space 76 between the walls 70, 72 is directed passed the chute 18 by the reverse bend 42 in the stationary guard portion 32.

The guide 60 is mounted to the chute block 48 by fasteners 78, such as bolts that are spaced from one another to define gaps between the bolts 78. The guide 60 is also spaced from the chute block 48 (by, for example, spacers 80 on the bolts 78 between the guide 60 and the block 48) to provide sufficient space between the guide 60 and block 48 for debris to fall through. The guide 60 can also include an adjustable 82 stop to prevent over-flexing of the movable guard 34.

Figure 5:
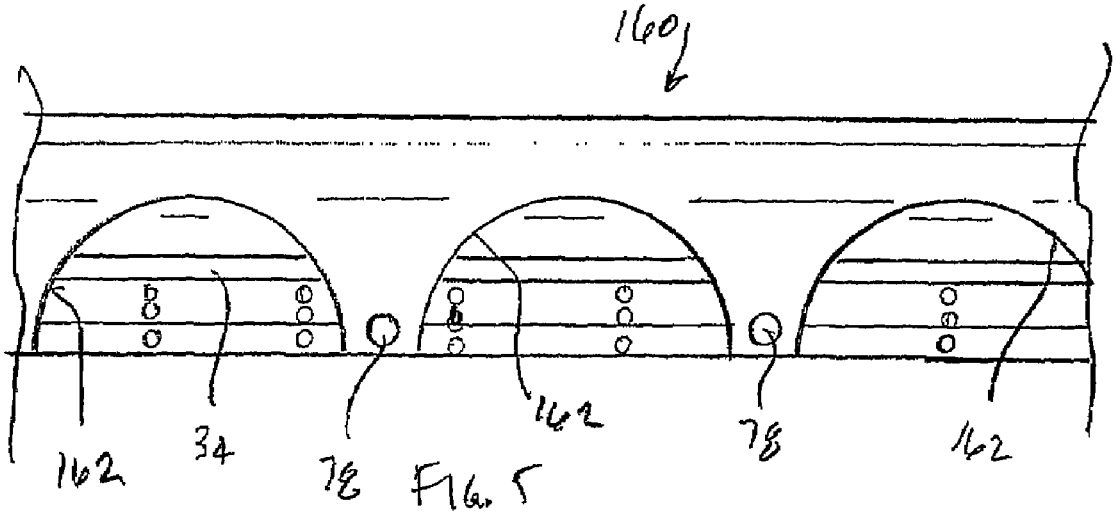
FIG. 5 is a side view of an alternate chute and release system guide.
Figure 6:
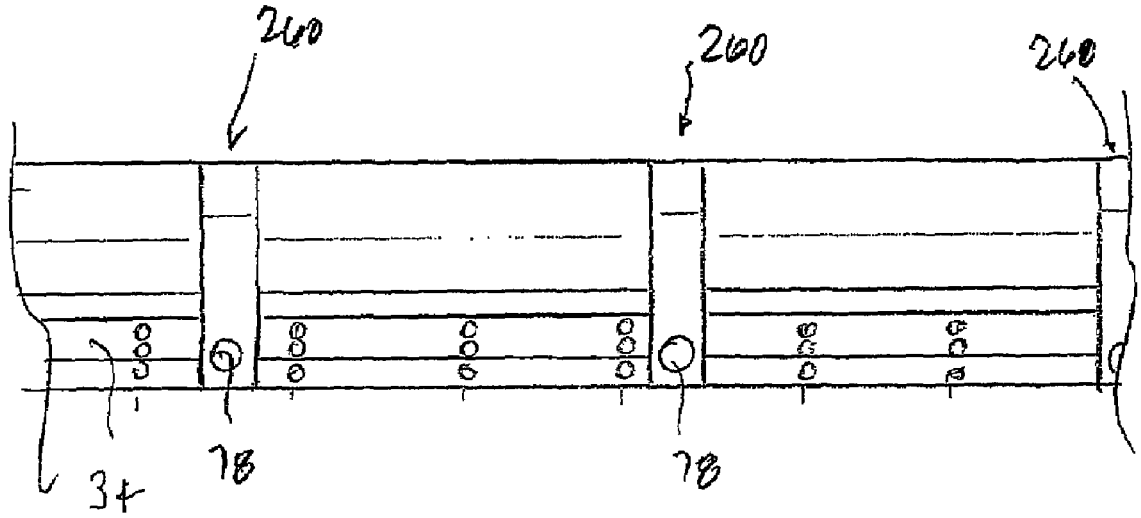
FIG. 6 is a side view of still another alternate guide

As seen in FIG. 5, the guide 160 can be configured with large cut-out sections 162 (FIG. 5) to permit debris to fall from the chute. This reduces the chance for the chute to become clogged, while still providing the guide and protective functions of the guide 160. As seen in FIG. 6, the guide 260 can be configured as one or a series of pickets, again to permit debris to fall from the chute and to reduce the opportunity for the chute to become clogged, while still providing the guide and protective functions of the guide 260.

Figure 4:
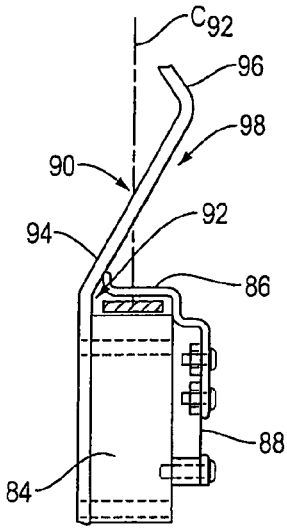
FIG. 4 is a cross-sectional view of a transition section between the bottom leg of the strap chute and one of the vertical legs, showing the asymmetrical chute and release system with the chute in the closed state and a strap within the chute.

Referring to FIG. 4, the configuration of the chute system 12 at the transition regions 30 is similar to that at the bottom leg 24. The chute system 12 includes a chute block 84 to which the movable guard 86 is biasedly mounted as by a flat spring 88. A stationary guard 90 is in opposing relation to the movable guard 86 and includes an inclined or angled wall 94 over the strap path 92. The guard portions 86, 90 meet along the inclined portion 94 of the stationary guard 90 to close the chute 18. The stationary guard portion 90 extends (at the incline 94) beyond the end of the strap path 92 and then forms a reverse bend 96 back over the center $C_{92}$ of the strap path 92 to form an overhang 98 over the movable guard 86. This establishes the "blind" over the chute when it is open. The guide is not necessary for the transition regions (although it can be used), nor is the stationary guard upper extension, beyond the reverse bend 96. It has been found that these structures are not needed for the proper operation of the asymmetrical chute and release system in that the strap will tend to contact the load in a vertical location corresponding to the located bottom strap.

Another important advantage of the present chute system is that can be retrofitted to many presently known strapping machines. That is, the bottom chute systems and the transition sections of some known strapping machines can be readily replaced with the present asymmetrical strap chute system without averse effect to the machines and/or the systems and processes within which they are situated.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. An asymmetrical chute system for a strapping machine of the type for feeding a strapping material around a load, positioning, tensioning and sealing the strapping material around the load, the strapping machine having a feed head for feeding the strapping material into strapping machine, a strap chute defining a strap path through which the strapping material is passed and a sealing head to seal overlapping courses of the strapping material onto itself, the asymmetrical chute system comprising a base;

a stationary guard, the stationary guard having an inclined wall extending, at least in part, over the strap path; and a movable guard, wherein the stationary guard is stationary relative to the base and the movable guard, and wherein the movable guard is movable relative to the base and the stationary guard, the movable guard being movable into engagement with the stationary guard inclined wall to open and close the strap path, wherein when the movable guard is open, the inclined wall extends over the strap path so as to form a blind portion intersecting a line normal to the strap path wherein the stationary guard includes a reverse bend extending from the inclined wall and back over the line normal to the strap path, and the stationary guard further includes a portion extending from the reverse bend defining a stationary guard exit wall configured as an exit path for the strapping material to move toward the load, the stationary guard exit wall is positioned substantially parallel to the line normal to the strap path.

2. The asymmetrical chute system in accordance with claim 1 including a guide mounted at about the base, spaced from the stationary guard, wherein the movable guard is disposed between the stationary guard and the guide.

3. The asymmetrical chute system in accordance with claim 2 wherein the guide is fixedly mounted relative to the stationary guard and the base.

4. The asymmetrical chute system in accordance with claim 3 wherein the guide includes at least one bend to define a guide exit wall substantially parallel to and spaced from the stationary guard exit wall, the guide exit wall and stationary guard exit wall defining a strap exit to and aligned with the strap path.

5. The asymmetrical chute system in accordance with claim 4 wherein the guide is mounted at about the base, and spaced therefrom to define a debris ejection path.

6. The asymmetrical chute system in accordance with claim 1 wherein the movable guard is mounted to the base by a biasing element and is biased into engagement with the stationary wall.

7. The asymmetrical chute system in accordance with claim 6 wherein the biasing element is a flat spring.

8. The asymmetrical chute system in accordance with claim 1 wherein the movable guard includes a path forming leg that, in conjunction with the base, defines a path for the strap through the strap chute.

9. A strapping machine of the type for feeding a strapping material around a load, positioning, tensioning and sealing the strapping material around the load, comprising:

a frame;

a sealing head;

a feed head, the sealing head and the feed head operably mounted to the frame; and a strap chute defining a strap path through which the strapping material is passed from the feed head to the sealing head, the strap chute including an asymmetrical chute system along a bottom leg of the strap chute, including a base, a stationary guard having an inclined wall extending, at least in part, over the strap path and movable guard, wherein the stationary guard is stationary relative to the base and the movable guard, and wherein the movable guard is movable relative to the base and the stationary guard, the movable guard being moveable into engagement with the stationary guard inclined wall to open and close the strap path, wherein when the movable guard is open, the inclined wall extends over the strap path so as to form a blind portion intersecting a line normal to the strap path wherein the stationary guard includes a reverse bend extending from the inclined wall and back over the line normal to the strap path, and the stationary guard further includes a portion extending from the reverse bend defining a stationary guard exit wall configured as an exit path for the strapping material to move toward the load, the stationary guard exit wall is positioned substantially parallel to the line normal to the strap path.

10. The strapping machine in accordance with claim 9 wherein the movable guard is mounted to the base by a flat spring to bias the movable guard into engagement with the stationary wall.

11. The strapping machine in accordance with claim 10 including a guide fixedly mounted at about the base, spaced from the stationary guard, wherein the movable guard is disposed between the stationary guard and the guide, the guide including at least one bend to define a guide exit wall substantially parallel to and spaced from the stationary guard exit wall, the guide exit wall and stationary guard exit wall defining a strap exit parallel to and aligned with the strap path.

12. The strapping machine in accordance with claim 11 wherein the guide is mounted at about the base, and spaced therefrom to define a debris ejection path.

13. The strapping machine in accordance with claim 9 wherein the movable guard includes a path forming leg that, in conjunction with the base, defines a path for the strap through the strap chute.

14. The strapping machine in accordance with claim 9 wherein the bottom leg of the strap chute has junctures with vertical legs adjacent to the bottom leg and wherein one or both of the junctures include an asymmetrical strap system having a base, a stationary guard having an inclined wall extending, at least in part, over the strap path and a movable guard, wherein the stationary guard is stationary relative to the base and the movable guard, and wherein the movable guard is movable relative to the base and the stationary guard, the movable guard being movable into engagement with the stationary guard inclined wall to open and close the strap path, wherein when the strap path is open, the inclined wall extends over the strap path so as to form a blind portion intersecting a line normal to the strap path.

* * * * *

UNITED STATES PATENT AND TRADEMARK OFFICE

CERTIFICATE OF CORRECTION

PATENT NO. : 7,237,478 B1
APPLICATION NO. : 11/461789
DATED : July 3, 2007
INVENTOR(S) : Gosis et al.

It is certified that error appears in the above-identified patent and that said Letters Patent is hereby corrected as shown below:

Claim 4, Col. 6, line 5 should read:

--stationary guard exit wall defining a strap exit parallel to and aligned--

Signed and Sealed this

Fourteenth Day of August, 2007

JON W. DUDAS
*Director of the United States Patent and Trademark Office*